United States Patent [19]

Bouchez et al.

[11] Patent Number: 4,804,495

[45] Date of Patent: Feb. 14, 1989

[54] REDUCED VISCOSITY HEAVY HYDROCARBON COMPOSITION IN FORM OF MULTIPLE EMULSION AND ITS PRODUCTION

[75] Inventors: Dominique Bouchez, Oullins; Gilbert Casamata, Toulouse; Pascale Fournier, Blagnac; Christian Bernasconi, Charly par Vernaison, all of France

[73] Assignee: Societe Anonyme Elf France, France

[21] Appl. No.: 923,968

[22] Filed: Oct. 28, 1986

[30] Foreign Application Priority Data

Oct. 29, 1985 [FR] France ..... 85 16021

[51] Int. Cl.[4] ..... B01J 13/00; C10L 1/32

[52] U.S. Cl. ..... 252/312; 44/51; 106/285; 252/309; 252/314

[58] Field of Search ..... 252/312, 309, 314; 44/51; 106/285

[56] References Cited

U.S. PATENT DOCUMENTS

| | | | |
|---|---|---|---|
| 3,732,084 | 5/1973 | Nixon et al. | 44/51 |
| 3,948,617 | 4/1976 | Withorn | 44/51 X |
| 4,013,475 | 3/1977 | Liebowitz et al. | 252/309 X |
| 4,254,105 | 3/1981 | Fukuda | 514/762 |
| 4,328,149 | 5/1982 | Morse et al. | 524/801 X |
| 4,394,131 | 7/1983 | Marro, Jr. et al. | 44/51 |

FOREIGN PATENT DOCUMENTS

| | | | |
|---|---|---|---|
| 3023372 | 1/1982 | Fed. Rep. of Germany | 44/51 |
| 0153092 | 9/1982 | Japan | 44/51 |
| 0103590 | 6/1983 | Japan | 44/51 |

*Primary Examiner*—Richard D. Lovering

*Attorney, Agent, or Firm*—Ostrolenk, Faber, Gerb & Soffen

[57] ABSTRACT

Composition comprising heavy hydrocarbons and water, having a viscosity much lower than that of the hydrocarbons it contains. It is constituted by a multiple emulsion, the internal phase of which comprises a primary emulsion of water in the hydrocarbons and the external phase comprises water containing at least one surfactant, in which this primary emulsion is dispersed, thus forming a secondary emulsion which is self-stable or is stabilized by the addition of stabilizing agents to its external phase.

20 Claims, No Drawings

REDUCED VISCOSITY HEAVY HYDROCARBON COMPOSITION IN FORM OF MULTIPLE EMULSION AND ITS PRODUCTION

The present invention relates to a new composition based on heavy hydrocarbons, having a viscosity substantially lower than that of the hydrocarbons themselves. It comprises a process for putting viscous hydrocarbons into the form of such a composition; this process comprises an industrial means for substantially reducing the viscosity of various hydrocarbon products or residues, thus making manipulation and uses of them easier.

A particularly advantageous application invention concerns heavy residues from petroleum distillation, which are very viscous and thus difficult to transport and to use as fuels or as coatings.

According to the current technique, such viscous products are employed in mixtures with lighter hydrocarbons. This is the case with fuels known as heavy fuels, the viscosity and also the S content of which are reduced to the values required by specifications, particularly 40 cSt at 100° C. and 4% of sulphur. However, the consumption of the lighter fractions, as for example gas oil, for the dilution of very viscous residues is disadvantageous for oil industry economy, particularly when the proportion of diluent attains about 10 to 20%. It is thus very desirable to find another means for reducing the viscosity of very heavy hydrocarbons. The dispersion of water in the hydrocarbon known in practice, which improves combustion, is not suitable, because it causes an increase in the viscosity. As regards emulsions of hydrocarbons in water, even if this technique permits a significant reduction in the viscosity, combustion is more difficult because of the presence of water on the exterior, which has to be evaporated.

The present invention brings to this technique a new and very effective and extremely economic means, which allows reduction of the viscosity of heavy hydrocarbons in wide proportions, without the addition of other fuels. It also renders possible improvement in the combustion of hydrocarbons and elimination of the sulphur present; thus it permits considerable improvement in combustion by reducing the noncombustibles at least to a tenth, in comparison with combustion of the heavy fuel.

The process according to the invention consists in putting viscous hydrocarbons into the form of a multiple emulsion with water, which constitutes the minor part of the total weight. Thus, in particular, the composition according to the invention is an emulsion of the W/O/W' type, that is to say a secondary emulsion, in water (W'), of a primary emulsion of water (W) in the hydrocarbon (O).

The use of such a multiple emulsion according to the invention for reduction of the viscosity results from the unexpected fact that, despite the increase in viscosity following dispersion of the water in the hydrocarbons, W/O, the combination undergoes a considerable drop in viscosity when this W/O system is in turn dispersed in an aqueous external phase, giving W/O/W', even for relatively low proportions of W'.

As mentioned above, the invention affords two other advantages in addition to fluidification of the product. Thus the presence of particles of water W in the primary emulsion W/O yields an improvement in combustion. On the other hand, reactants capable of reacting with sulphur in the hydrocarbons utilized, particularly alkali or alkaline earth metal hydroxides or carbonates, can convert the sulphur to the form of the sulphate, for example $CaSO_4$, $Na_2SO_4$, etc.

As the dispersion of water in hydrocarbon materials is known, the primary emulsion W/O of the compositions according to the invention can be prepared according to the prior art. This requires very good agitation of about 3 to 10% of water, preferably 5 to 6% by weight, and the hydrocarbons for the droplets of water to have dimensions below 10 microns, with a preferential range of 0.1 to 5 microns and most preferably about 1 μm. As is known, such a degree of dispersion can be obtained for example with a centrifuge pump, a colloidal mill or with the aid of ultrasound.

When the hydrocarbon treated contains surfactant molecules, which is particularly the case with petroleum distillation residues, the primary emulsion W/O can be prepared without the addition of an emulsifier; in other cases, a small addition has to be effected, generally of 0.1 to 2% of the surfactant compound, according to standard practice.

Because the invention is generally applicable to all materials which at the ambient temperature are too viscous to be capable of manipulation, it is often necessary to heat them in a manner so that it becomes possible to emulsify them with water. Depending upon their viscosity, the temperature of this operation varies in general from 30° to 100° C. and particularly between 50° and 70° C. for heavy No. 2 fuels and heavy residues of petroleum distillation. It is possible to exceed 100° C., employing a technique of emulsification under pressure, permitting the use of the heaviest residues.

The secondary emulsion W/O/W' of the foregoing W/O in water, W', is produced by the agitation of the primary emulsion and water (W') in which has been dissolved an appropriate proportion of the surfactant, in general 0.5 to 5% by weight and most prefeably from 1 to 3%. There is a concentration threshold for the surfactant below which the production of the multiple emulsion W/O/W' is providential. With the heavy petroleum products mentioned above, this threshold is located at about 0.3%; this is the reason why the process of the invention is preferably carried out with contents clearly exceeding this value in the secondary water (W').

As regards the nature of the surfactant agent or agents, they can be of any known anionic, cationic or nonionic type. Very good results are obtained with sulphonates, particularly the lignosulphonates, or also with petroleum sulphonates and in addition with fatty amines salified by mineral or organic acid.

In the external phase of the composition according to the invention, namely the secondary water W', the surfactant can, if required, by replaced by a very fine powder in suspension in this water and moistened by it. The use of carbon powder for this purpose is very interesting, because it increases the calorific power of the composition.

The multiple emulsions produced can be self-stable due to the judicious use of adequate surfactants. In certain cases, it can be necessary to add one or more stabilizing agents to the external aqueous phase, such as for example xanthan, agar-agar, guar, alginates and carageenin gums; alkoxy-, carboxy and hydroxy-alkyl celluloses; polyacrylates, polyacrylamides and polyacrylate-polyacrylamides; water-soluble flocculant metal salts, such as the chlorides, sulphates, nitrates, bicarbonates, sulphites, carboxylates and others of Ca, Mg, Al and Fe. These agents are cited only by way of non-limitative examples.

For certain stabilizers, it is necessary also to add a biocidal product to the aqueous external phase, in order to avoid any bacterial or fungal growth during storage of long duration at ambient temperature of the stabilized multiple emulsion.

Although the multiple emulsions between water and hydrocarbons described in the technical literature generally contain only about 15 to 20% of hydrocarbon for a total of 85 to 80% water, 60 to 70% of which is external water (N. GARTI et coll., J. Dispersion Sci. and Techn., vol. 4, No. 3, p 237–252,(1983); S. MATSUMOTO et coll., J. Colloid and Int. Sci., vol. 77, No. 2, p.555–563, (1980)), the present invention provides the advantage of having about 70 to 80% of hydrocarbon with 20 to 30% of total water, 15 to 27% of which is in the external phase. To realise this result, unexpected in relation to the prior art, the process and composition according to the invention must satisfy the conditions indicated above and also the droplets of the primary emulsion W/O in the secondary emulsion W/O/W' must be 2 to 50 times larger than the droplets of water W in the primary emulsion. Preferably, they are 5 to 10 times and most preferably 8 to 12 times larger. In other words, when the droplets of the internal water (primary emulsion) have dimensions of the order of 1 to 5 microns, the water/hydrocarbon droplets in the secondary emulsion, water/hydrocarbon/water, should for example measure about 10 to 100 microns.

As regards the temperatures at which the secondary emulsion is produced, they are the same as for the primary emulsion as described above.

If the conditions of preparation according to the invention are respected, the primary emulsion is not broken when it is agitated, in view of the formation of the secondary emulsion under strong shearing. This disadvantage mentioned in the prior art (FLORENCE and WHITEHILL, J. Colloid and Int. Sci., vol. 79 No. 1, P.243–256, 1981) is not produced with appropriate agitation in the process of the invention.

It is to be noted that it is of interest to agitate the medium well in view of the formation of the secondary emulsion in order to obtain a heterogeneous granulometry which produces better filling of the dispersed system.

To the observations on the nature of the surfactant agents given above, there can be added the following non-limitative list of agents which are easily obtainable commercially.

Non-ionic agents: "TWEEN 80" polyoxyethylene sorbitan mono-oleate;
"TWEEN 20"—mono-laurate of the same sorbitan;
"SPAN 80"—sorbitan mono-oleate;
"BRIJ 35"—polyoxyethylated lauryl alcohol.

Anionic agents: lignosulphonates, particularly of sodium or ammonium, in particular the products of the AVEBENE company known by the codes N7, T5P, NCA or the products of the BORREGAARD company under the name Vanisperse CB or Borresperse CB.

Cationic agents: "DINORAM S" hydrochloride—N-alkyl propylene diamine hydrochloride ($C_{12}$–$C_{18}$ alkyls);

"POLYRAM S" hydrochloride—N-alkyl-polypropylene-polyamine hydrochloride ($C_{12}$–$C_{18}$ alkyls).

While the relative proportions of the components of the composition according to the invention can vary within the limits indicated in the foregoing description, the preferable proportions are, by weight: 5 to 6% for the internal water dispersed in the hydrocarbon; 33 to 82% of the primary emulsion in the external water phase; surfactants in the external water phase 1 to 2.5% or 0.2 to 0.9% of the total.

The most preferred compositions contain 75 to 80% of the primary emulsion and 0.3 to 0.8% of surfactant agents, contents of 0.4% being the most suitable.

As the pH affects the conditions of preparation or stability of the emulsions, the invention is preferably carried out with a medium of a pH limited between 5 and 10; the best results are obtained in the region of 7, particularly between 6 and 8. With pH values which are too low, emulsification is difficult, while for pHs which are too high, there is a risk of inversion of the emulsion and the viscosity is not reduced sufficiently.

The invention is illustrated non-limitatively by the examples which follow.

EXAMPLE 1

Preparation of a primary emulsion

2kkg of heavy fuel No. 2 ex RSV of density 0.994 at 20° C. and having a viscosity of 425 cP measured at 50° C. are placed in a vessel in which an emulsifier is immersed. The fuel is heated to 55°±5° C. until it can be transmitted by a pump, the input to which is connected to the base of the vessel and the return to its top. The temperature is maintained throughout all the period of circulation of the fuel.

Then 0.105 kg of water is added and circulation of the fuel is continued at 55°±5° C. for 8 minutes. The primary emulsion so formed contains 4.98% of water and the average dimension of its droplets of water is about 2 microns, the major part having diameters of 1 to 5 μm.

EXAMPLE 2

Preparation of a secondary emulsion

In a receptacle of 1 liter capacity provided with a magnetic agitator and a thermostated heating device, 73.5 g of water are introduced, containing in solution 1.5 g or 2.04% of the surfactant known commercially under the name "VANISPERSE CB" (Na lignosulphonate). This water is agitated at the rate of 2815 revs per min and then there is slowly added over 10 minutes 282 g of the primary emulsion of example 1, the composition being maintained at a temperature of 60°±5° C.

After introduction of the primary emulsion, in order to improve its stability, the secondary emulsion obtained is passed into a small centrifugal pump producing 0.6 liters per min. After 10 minutes of this circulation, a multiple emulsion is obtained having the following characteristics:

| | |
|---|---|
| Fuel | 268.00 g or 75.07% |
| Primary water | 14.06 g or 3.94% |
| Secondary water | 73.50 g or 20.60% |
| Surfactant | 1.50 g or 0.42% |
| | 357.— |

The pH of this product is 6.8.

Measured at 50° C., the viscosity of the multiple emulsion obtained is 28 cP as against 425 cP for the initial fuel or 1/15th thereof, which is thus considerably reduced.

On the other hand, at 25° C. the apparent viscosity of the multiple emulsion is 260 cP at 100 $s^{-1}$ as against 6,500 cP for the initial fuel. The reduction by emulsification according to the invention is thus about 25 times at ambient temperature.

The droplets of the secondary emulsion in the multiple emulsion formed have an average dimension of about 20 microns or 10 times that of the primary emulsion.

EXAMPLE 3

The operations of Example 2 are repeated in a 14 liter vessel, into which is introduced 1350 g of water containing 1.12% of the same surfactant and then 4027 g of the primary emulsion according to example 1.

Agitation is effected at a variable speed between 0 and 2500 revs in place of the 2815 revs per min of Example 2.

About 25 minutes is necessary to obtain the multiple emulsion. This has an apparent viscosity of 325 cP at 25° C. for 50 $s^{-1}$ or 20 times less than that of the heavy fuel treated.

EXAMPLE 4

Preparation of a secondary emulsion from a heavy residue

The operations are similar to those of Example 2, but the primary emulsion utilized was obtained from a heavy residue of the distillation of a crude petroleum of the DJENO type. This primary emulsion, prepared at 75°±5° C., comprises 95% of the heavy residue and 5% of water in droplets of 1 to 6 microns; it has a viscosity of 4015 cP at 50° C. In a vessel provided with a magnetic agitator as an emulsifier and heating means with a thermostat, 64.7 g of water are introduced mixed with 1.3 g or 2% of the same VANISPERSE CB surfactant as in the foregoing Example; the temperature is regulated to 75°±5° C. and the agitator is rotated continuously at 2800 revs per min and then 211 g of the primary emulsion are slowly introduced over 10 minutes.

Contrary to Example 2, the stability of the secondary emulsion obtained is not increased by passage through a small centrigal pump.

The emulsion has the following overall composition:

| | |
|---|---|
| Heavy residue | 200.5 g or 72.36% |
| Total water | 75.2 g or 27.15% |
| Surfactant | 1.3 g or 0.47% |
| | 277.0 g |

The pH of the product is 7.4.

Its apparent viscosity at 50° C. is 200 cP as against 3500 cP for their initial heavy residue; it has thus been diminished 17.5 times, thus yielding a readily utilisable residue, particularly for combustion in standard burners.

EXAMPLE 5

The operations of Example 4 are repeated, but at the end of 10 minutes of a9itation in the vessel, the secondary emulsion obtained is passed into a small centrifugal pump delivering 0.45 kg per min; this pumping lasts 8 minutes and causes an improvement in the stability of the multiple emulsion.

EXAMPLE 6

In the mode of operation of Example 2, the anionic surfactant based on a ligno-sulphonate is replaced by a nonionic agent, known in commerce under the name TWEEN 20 (sorbitan polyoxyethylene mono-oleate).

The same results are obtained, but it is necessary to agitate the mixture for 15 minutes, in place of 10 minutes in the case of Example 2.

EXAMPLE 7

The operations of Examples 4 and 5 are repeated with DINORAM S hydrochloride (N-alkyl-propylenediamine hydrochloride with $C_{12}$–$C_{18}$ alkyls) in place of the VANISPERSE CB (ligno-sulphonate). The steps proceed in the same fashion, but it is necessary to operate the magnetic agitator for 17 minutes in place of 10 in order to obtain the equivalent multiple emulsion.

EXAMPLE 8

The operations of Example 4 are repeated, but to the aqueous phase serving to constitute the secondary emulsion, there is added 7.10 g of a 2% aqueous solution of RHODOPOL 23 (500 ppm of RHODOPOL 23 with rspect to the composition of the multiple emulsion), xanthan gum sold commercially by the RHONE-POULENC company. Operation then continues as indicated in Example 4. The multiple emulsion obtained indicated no sign of instability after a period of 3 months.

EXAMPLE 9

The operations of Example 4 are repeated, but to the multiple emulsion obtained with moderate agitation (agitation with a magnetic rod), there is added 7.10 g of a 2% aqueous solution of RHODOPOL 23 also containing 0.142 g of pure formal (0.384 g of a 37% aqueous formal solution) (500 ppm of RHODOPOL 23 and 500 ppm of formaldehyde with respect to the multiple emulsion composition). The multiple emulsion obtained indicated no sign of instability or bacterial or fungal production or growth for a period of three months at ambient temperature.

EXAMPLE 10

400 kg of multiple emulsion are made in a pilot plant comprising a colloidal mill and the necessary means for measuring and incorporating the constituents of the mixture. The characteristics of the apparatus are: total maximum yield of the installation 300: l/h; water feed by piston metering pump (90 l/h max); feed of additive by piston metering pump (15-16 l/h max); feed of hydrocarbons by centrifuge group (300 l/h max).

The multiple emulsion was made in two stages.

The supply vessel of 50 liters was filled with heavy fuel of viscosity 425 cP at 50° C. Heated to 50° C., this fuel was introduced into the colloidal mill at a rate of 140 l/h. Water was added at a rate of 8 l/h forming a primary emulsion of the oil in water type (W/O) having 5.4% of water.

Adjustment of the colloidal mill was effected so as to have minimum gap between the rotor and the stator, namely 0.2 mm. 300 kg of the primary emulsion so formed were then stored. The colloidal mill was then adjusted to have a gap of 0.5 mm between the rotor and the stator for formation of a second emulsion, in order to obtain a different fineness from that of the first.

The additive DINORAM S hydrochloride (cationic, N-alkyl propylenediamine hydrochloride with $C_{12}$–$C_{18}$ alkyls) was prepared in solution in water at a concentration of 5%. Supply of the additive was effected at a rate of 15 l/h, the water at a rate of 30 l/h while the output of emulsion was 105 l/h.

A multiple emulsion was obtained of the following composition:

| | |
|---|---|
| RSV fuel | 66.22% |
| Water | 33.28% |
| Surfactant | 0.5% |

The viscosity of this emulsion was:

87 cP at 23° C.

35 cP at 40° C.

25 cP at 60° C.

as against 425 cP at 50° C. for the initial fuel.

The granulometry of the primary emulsion was similar to that of Example 1. The second emulsion had the following granulometric distribution:

77.8% < 80 μm, average diameter 32.5 microns with 20% of particles < 14.5 microns and 5.3% of particles < 2 microns.

EXAMPLE 11

400 kg of the multiple emulsion pepared according to Example 10 were heated in a Guillot Totaltub heater of 1500 th/h equipped with a Cuenod PCS 300 burner with mechanical pulverisation by a Monarch pressure jet.

The multiple emulsion was stored in a separate vessel. The burner was first lit with domestic fuel; supply of the emulsion was effected progressively, ignition being effected without difficulty. The flame visually appeared more radiant. It was possible to burn the product with a preheat temperature below 90° C. The most marked result was the level of non-combustibles which was very much reduced in comparison with the standard combustion of heavy fuel. Thus, only 50 mg/th was found, while the non-combustibles exceeded 500 mg/th in the same plant when burning heavy fuel which had been preheated to 140° to 150° C. The multiple emulsion according to the invention thus had less than a tenth of the non-combustibles emitted in the combustion of the heavy fuel.

We claim:

1. Composition comprising at least 66.2% heavy hydrocarbons and water having a viscosity much lower than that of the hydrocarbons, said hydrocarbons being too viscous to be capable of manipulation of ambient temperature, characterized by comprising a multiple emulsion the internal phase of which is constituted by a primary emulsion of water in the hydrocarbons and the external phase by water containing at least one surfactant, in which the primary emulsion is dispersed, thus forming a secondary emulsion, the droplets of the primary emulsion in the secondary emulsion being 2 to 50 times larger than the droplets of water in the primary emulsion.

2. Composition according to claim 1, characterised in that the hydrocarbons have a viscosity of at least 425 cP at 50° C., in that the primary emulsion forms 33 to 82% by weight of the total and that it contains 3 to 10% water with respect to the weight of hydrocarbons.

3. Composition according to claim 1 or 2, characterised by containing about 70 to 80% by weight of hydrocarbons.

4. Composition according to claim 2, characterised in that the primary emulsion contains 5 to 6% water in the form of 0.1 to 5 micron droplets, and the pH of the external phase water is 6 to 8.

5. Composition according to claim 1, characterised in that its external aqueous phase contains at least one of a soluble basic alkali or alkaline earth compound and an insoluble fine powder.

6. Composition according to claim 5, characterised in that the external aqueous phase contains carbon powder.

7. Composition to claim 1, characterised in that the water content forming the external phase is about 20 to 30% by weight.

8. Composition according to claim 1, characterised in that the water of the external phase has a pH of 5 to 10.

9. Composition according to claim 1, characterised in that the droplets of water in the primary emulsion have dimensions below 10 microns.

10. Composition according to claim 1, characterised in that the droplets of the secondary emulsion measure in particular 10 to 100 microns.

11. Composition according to claim 1, characterised in that it contains 0.3 to 0.8% of at least one surfactant agent.

12. Composition according to claim 1, characterised in that it contains at least one stabilizer.

13. Composition according to claim 1, characterised in that it contains at least one biocidal agent.

14. Composition according to claim 1, characterised in that it has at 25° C. a viscosity of the order of 1/25th of that of the hydrocarbons which it contains.

15. Process for putting heavy hydrocarbons into a form having considerably reduced viscosity by dispersion in water, said hydrocarbons constituting at least 66.2 w % of the product and being too viscous to be capable of manipulation of ambient temperature, characterized in that a primary emulsion is first prepared having 3 to 10% of water in the hydrocarbons and this primary emulsion is then dispersed in the amount of 33 to 82% in water containing sufficient surfactant agent to form a secondary emulsion.

16. Process according to claim 15, characterised in that the hydrocarbons have a viscosity of at least 425 cP at 50° C., in that agitation, for formation of the emulsions, is such that the size of the droplets of water in the primary emulsion is about 0.1 to 5 microns and that the dimensions of the droplets of the primary emulsion in the external water are 10 to 100 times greater.

17. Process according to either of claims 15 and 16, characterised in that it is applied to hydrocarbons derived from the distillation of petroleum.

18. Process according to claim 15, wherein the hydrocarbon is is heavy fuels or heavy residues from the distillation of petroleum.

19. Process according to claim 15, characterised in that the primary emulsion is prepared having 5 to 6% water.

20. Process according to claim 15 characterised in that the hydrocarbons constitute about 70 to 80% by weight of the secondary emulsion.

* * * * *